US010236586B2

(12) United States Patent
Zelenski

(10) Patent No.: US 10,236,586 B2
(45) Date of Patent: Mar. 19, 2019

(54) CORRUGATED FEED HORN FOR PRODUCING AN OVAL BEAM

(71) Applicant: Winegard Company, Burlington, IA (US)

(72) Inventor: Alexander Anatoli Zelenski, Burlington, IA (US)

(73) Assignee: Winegard Company, Burlington, IA (US)

( * ) Notice: Subject to any disclaimer, the term of this patent is extended or adjusted under 35 U.S.C. 154(b) by 0 days.

(21) Appl. No.: 15/846,683

(22) Filed: Dec. 19, 2017

(65) Prior Publication Data

US 2018/0191076 A1 Jul. 5, 2018

Related U.S. Application Data

(60) Provisional application No. 62/441,835, filed on Jan. 3, 2016.

(51) Int. Cl.
*H01Q 13/02* (2006.01)

(52) U.S. Cl.
CPC ..... *H01Q 13/0208* (2013.01); *H01Q 13/0275* (2013.01)

(58) Field of Classification Search
CPC ..... H01Q 13/0275; H01Q 13/0208; H01Q 13/0216; H01Q 13/0225; H01Q 5/30
See application file for complete search history.

(56) References Cited

U.S. PATENT DOCUMENTS 5,486,839 A 1/1996 Rodeffer et al.
5,552,797 A * 9/1996 Cook ..... H01Q 13/0208 343/786
6,320,554 B1 11/2001 Yuanzhu

* cited by examiner

*Primary Examiner* — Robert Karacsony
(74) *Attorney, Agent, or Firm* — Dorr, Carson & Birney PC

(57) ABSTRACT

A corrugated feed horn for antenna has an oval pattern of corrugations, and a series of intermediate ridges spaced between adjacent corrugation ridges only in the regions of the slots near its major axis. The intermediate ridges provide a feed horn that is capable of producing a relatively uniform oval beam, and has enough corrugations per wavelength to guarantee little diffraction on the edges of the horn, thus resulting in an antenna with very low side lobes.

15 Claims, 8 Drawing Sheets

(PRIOR ART FEED HORN–AZIMUTH, HORIZONTAL POLARIZATION)

(PRIOR ART FEED HORN–AZIMUTH, VERTICAL POLARIZATION)

(AZIMUTH, HORIZONTAL POLARIZATION)

(AZIMUTH, VERTICAL POLARIZATION)

CORRUGATED FEED HORN FOR PRODUCING AN OVAL BEAM

RELATED APPLICATION

The present application is based on and claims priority to the Applicant's U.S. Provisional Patent Application 62/441,835, entitled "Corrugated Feed Horn For Providing An Oval Beam," filed on Jan. 3, 2017.

BACKGROUND OF THE INVENTION

Field of the Invention

The present invention relates generally to the field of corrugated feed horns for antennas. More specifically, the present invention discloses a corrugated feed horn providing an oval beam for an antenna.

Statement of the Problem

A feed horn used to illuminate an antenna with an oval aperture, with significant difference between the major and minor axes of the oval, has to produce an oval beam in order to achieve high efficiency for the antenna. At the same time, the oval beam should have a smooth shape with diminished side lobes at the reflector edge. It is known that for prevention of the back lobes and irregularities in the radiation patterns caused by diffraction at the E-plane edges of the horn, corrugations should be about a quarter wavelength deep to serve as chokes, and narrow enough to form a cutoff surface for the walls of the horn. The depth of the corrugation slots normally ranges from about a quarter to a half wavelength. The width of the corrugation ridges separating neighboring slots is kept to a minimum.

The prior art in this field includes U.S. Pat. No. 5,552,797 (Cook). In order to form an elliptical beam, Cook's proposed horn has a variable semi-flare angle. (The "semi-flare angle" 50 is defined as the angle between a line drawn parallel to the horn axis, and a line passing through the top surfaces of the adjacent ridges 20.) Two embodiments are presented by Cook—one with a flat aperture and variable corrugation widths (FIG. 5, 6), and the other with a non-flat aperture and a variable corrugation depth in addition to variable corrugation widths (FIGS. 9-12).

Cook's first embodiment discloses a horn with a flat aperture and variable corrugation widths. For a horn with an oval aperture, variable corrugation widths can be achieved by reducing the number of corrugations per wavelength along the major axis versus the minor axis. Widely-spaced choke slots make a horn frequency dependent. But, narrowly spaced choke slots along the major axis of the oval aperture result in narrower slots along the minor axis of the oval aperture of the horn, making the horn more difficult to manufacture. Also, having different choke widths results in the horn being frequency-dependent and producing higher levels of radiation at the reflector edge in different planes, which results in elevated side lobes for the reflector antenna illuminated by the horn.

In contrast, Cook's second embodiment discloses a horn with a non-flat aperture and a variable corrugation depth in addition to a variable corrugation width. This embodiment can be made almost round in axial projection (FIG. 10) and still be capable of forming an oval beam. The problem with this embodiment is the absence of a singular phase center in different planes passing through the axis of the waveguide feeding the horn due to variations in the semi-flare angle around the circumference of the horn. This causes the phase center to travel along the axis and results in elevated side lobes for the antenna illuminated by the horn.

Also, the Cook horn has very different patterns as a function of frequency, which do not result in uniform, low edge illumination of the reflector. To provide low side lobes for the antenna, edge illumination should be on the level of about −12 dB or better to prevent diffraction at the edge of the reflector. Thus, a need exists for a feed horn that address the shortcomings of both of these prior-art approaches.

Solution to the Problem

The present invention provides a feed horn having an oval pattern of corrugations with a series of intermediate ridges spaced between adjacent corrugation ridges only in the regions of the slots near its major axis. These intermediate ridges address the shortcomings associated with both of Cook's embodiments by providing a feed horn that is capable of producing a relatively uniform oval beam, and has enough corrugations per wavelength to guarantee little diffraction on the edges of the horn and can thus be used in an antenna with very low side lobes. At the same time, the corrugations have relatively uniform depths and widths, and does not require those corrugations to be overly narrow and is therefore easy to produce.

SUMMARY OF THE INVENTION

This invention provides a feed horn having an oval pattern of corrugations, and a series of intermediate ridges spaced between adjacent corrugation ridges only in the regions of the slots near its major axis.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
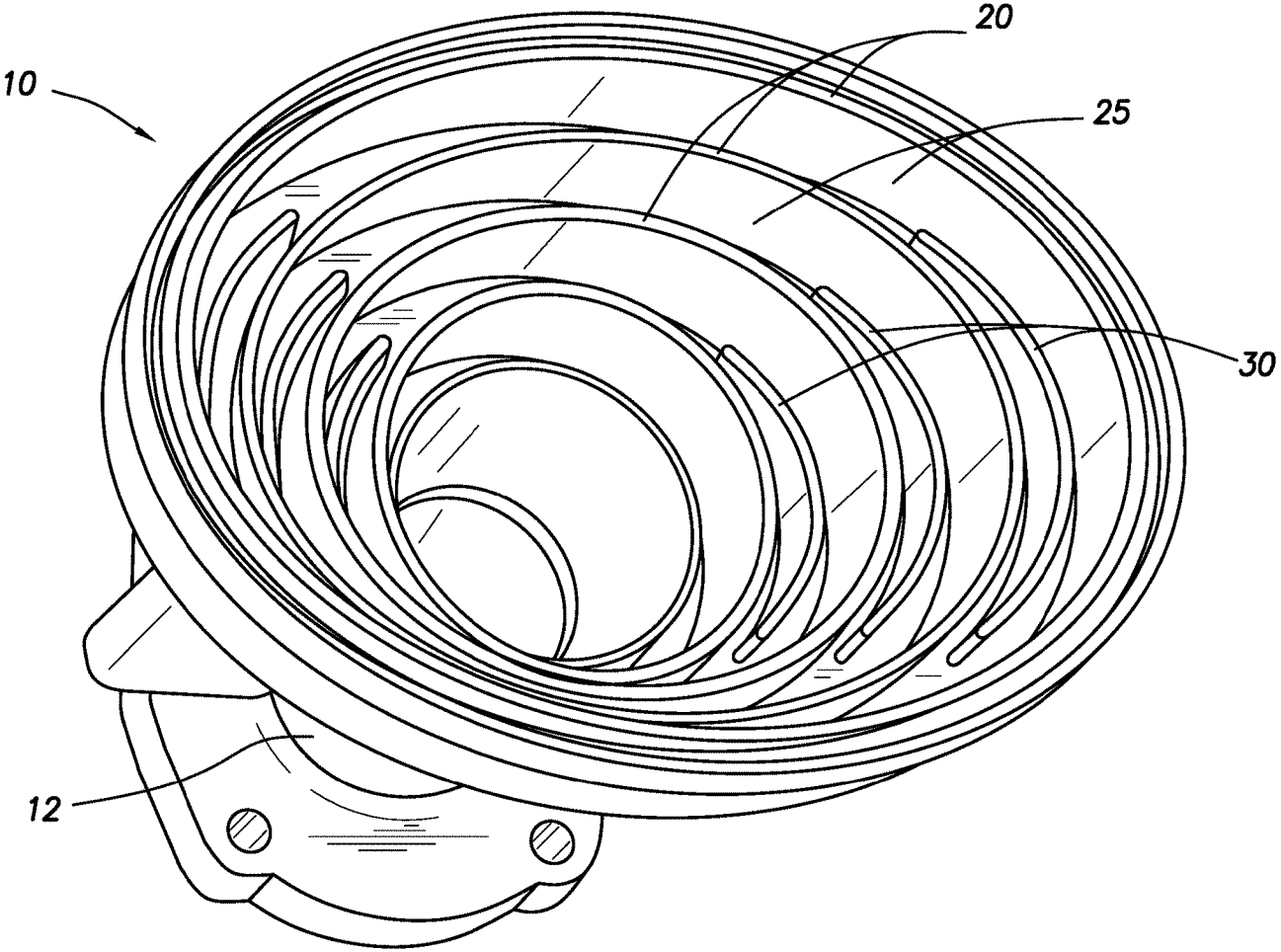
FIG. 1 is a front axonometric view of a feed horn 10 embodying the present invention.
Figure 3:
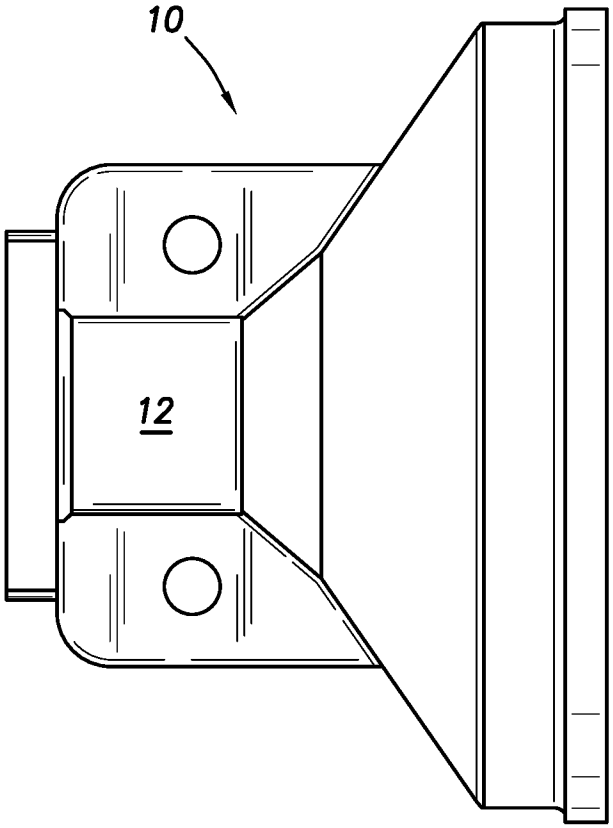
FIG. 3 is a side view of the feed horn 10 perpendicular to its major axis.

FIGS. 1-6 show one possible embodiment of the present feed horn 10. The feed horn 10 has a generally tubular waveguide 12 extending along a central projection axis 15 leading to an aperture. A plurality of corrugations extend outward from the projection axis 15 around the aperture of the horn 10 in a nested pattern of oval ridges 20 separated by slots 25. These oval ridges 20 rise generally parallel to the axis 15 of the feed horn 10.

It should understood that the term "oval" as used herein is not limited to shapes meeting the precise mathematical criteria of a true ellipse. This term should be broadly construed to include other rounded, non-circular shapes, such as a race track, a rounded rectangle, other symmetric or asymmetric rounded shapes, and the like.

Figure 2:
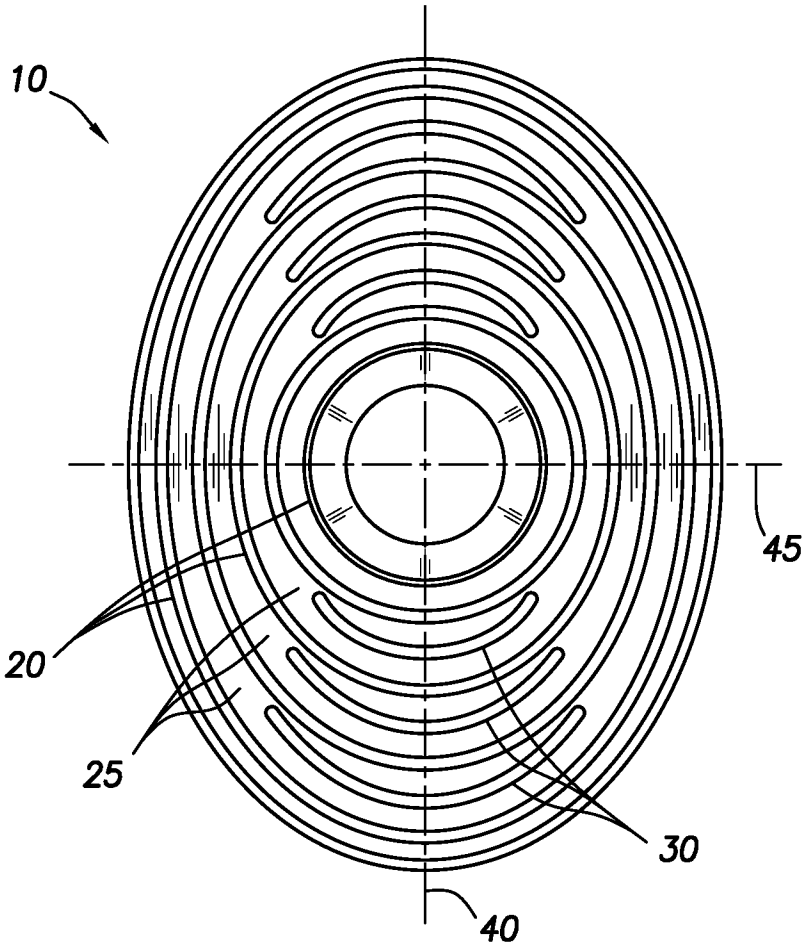
FIG. 2 is a front view of the feed horn 10 corresponding to FIG. 1.

When viewed from the front of the horn 10 as shown in FIG. 2, the oval corrugations have a major axis 40 along which the ridges 20 are more widely spaced (i.e., the slots 25 are wider near the major axis 40). Conversely, the corrugation ridges 20 are more closely spaced and the slots 25 are narrower adjacent to the minor 45 of the oval. The terms "major axis" and "minor axis" should also be broadly construed as applied to oval shapes. These are well defined mathematical terms with regard to ellipses, but should be understood that these general concepts can also be carried over to other oval shapes. The major and minor axes of oval shapes are usually obvious to an observer from visual inspection. However in general terms, the major axis is typically defined by the axis having the greatest spacing between adjacent ridges 20, and the minor axis is defined by the axis having the smallest spacing between adjacent ridges 20. The major and minor axes may or may not be orthogonal to one another, and do not necessarily bisect on another.

A series of intermediate ridges 30 are spaced between the corrugation ridges 20 in the regions of the slots 25 adjacent to the major axis 40, but not adjacent to minor axis 45, as shown in FIGS. 1 and 2. In other words, the intermediate ridges 30 are interstitially spaced between the corrugation ridges 20 only in those regions of the slots 25 near the major axis 40, as shown in the cross-sectional view along the major axis 40 depicted in FIG. 5. In contrast, FIG. 6 shows a cross-section along the minor axis 45, where there are no intermediate ridges between the corrugation ridges 20. The intermediate ridges 30 mitigate the problem of corrugations that are overly wide. Additionally, the intermediate ridges 30 help to maintain a more uniform slot width along both the major and minor axes 40, 45.

The intermediate ridges 30 can be curved to approximate the shape of the corrugation ridges 20. Space can be left between the ends of the intermediate ridges 30 and the adjacent corrugation ridges 20, as shown in FIGS. 1 and 2. Alternatively, these ridges 20, 30 could touch, but this configuration would be more difficult to mill.

Figure 5:
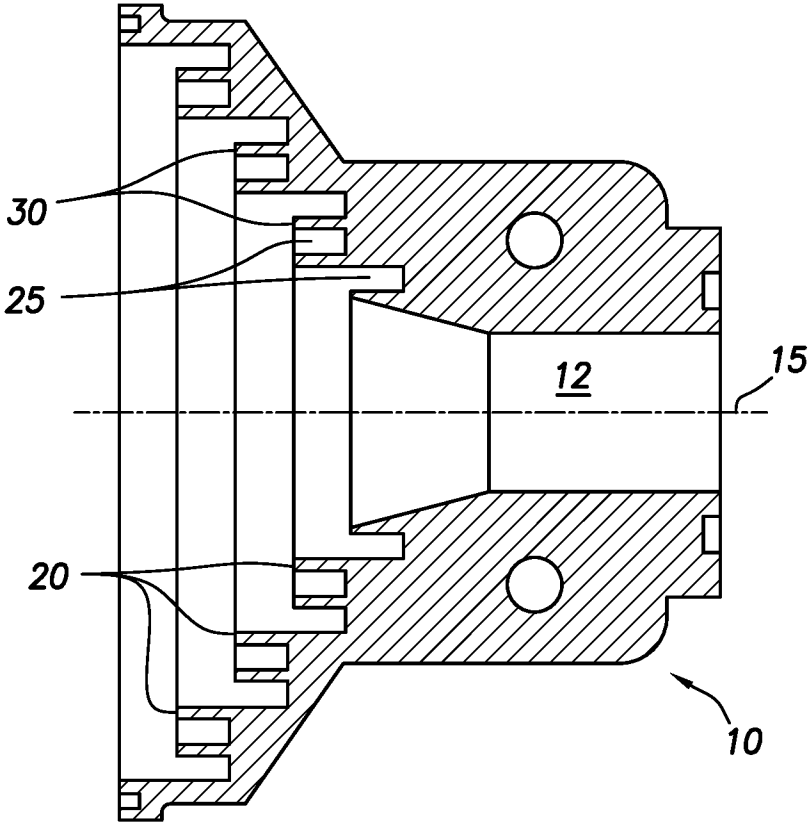
FIG. 5 is a cross-sectional view of the feed horn 10 through its major axis.
Figure 4:
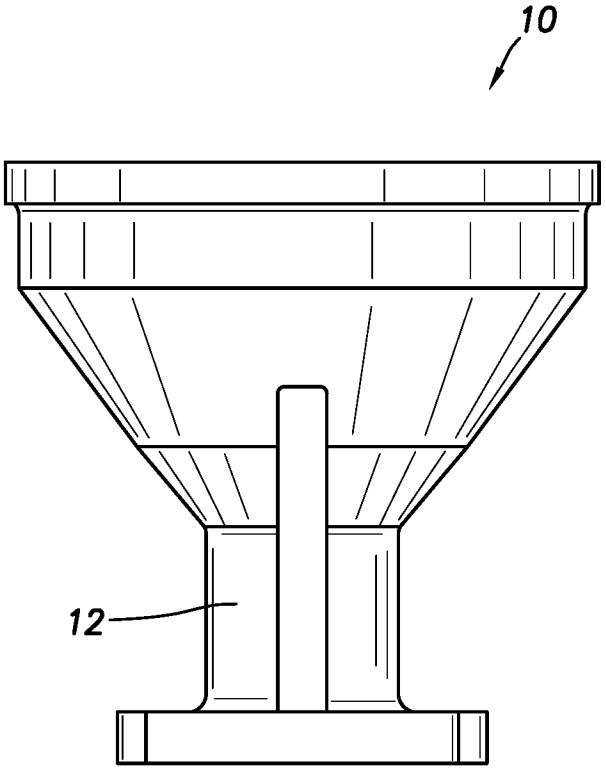
FIG. 4 is a side view of the feed horn 10 perpendicular to its minor axis.
Figure 6:
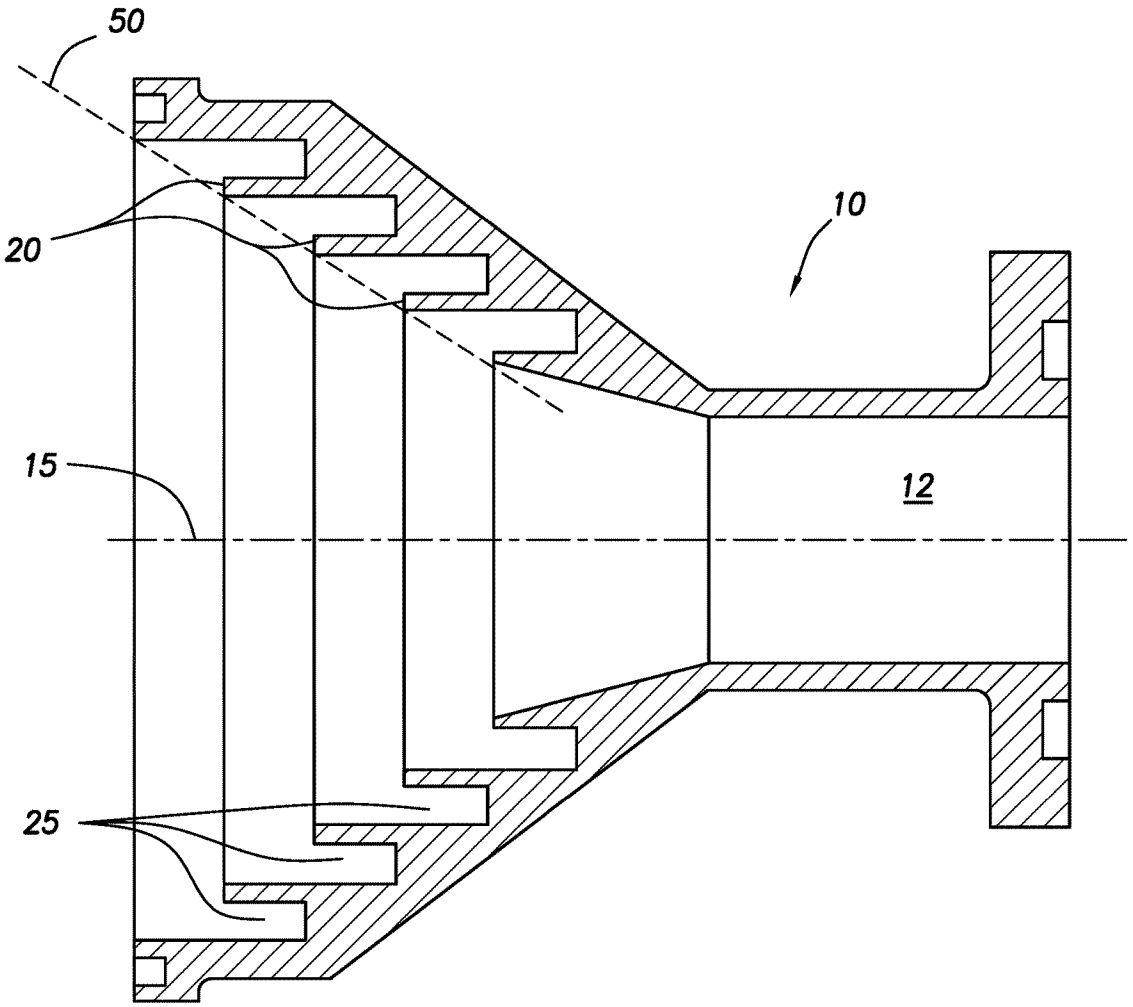
FIG. 6 is a cross-sectional view of the feed horn 10 through its minor axis.

The heights of the intermediate ridges 30 can be chosen to be the same as the adjacent corrugation ridge 20 closer to the center axis 15, as shown in FIGS. 1 and 5. Alternatively, the height can be somewhere between the heights of the two adjacent corrugation ridges 20 for each intermediate ridge 30.

Figure 7:
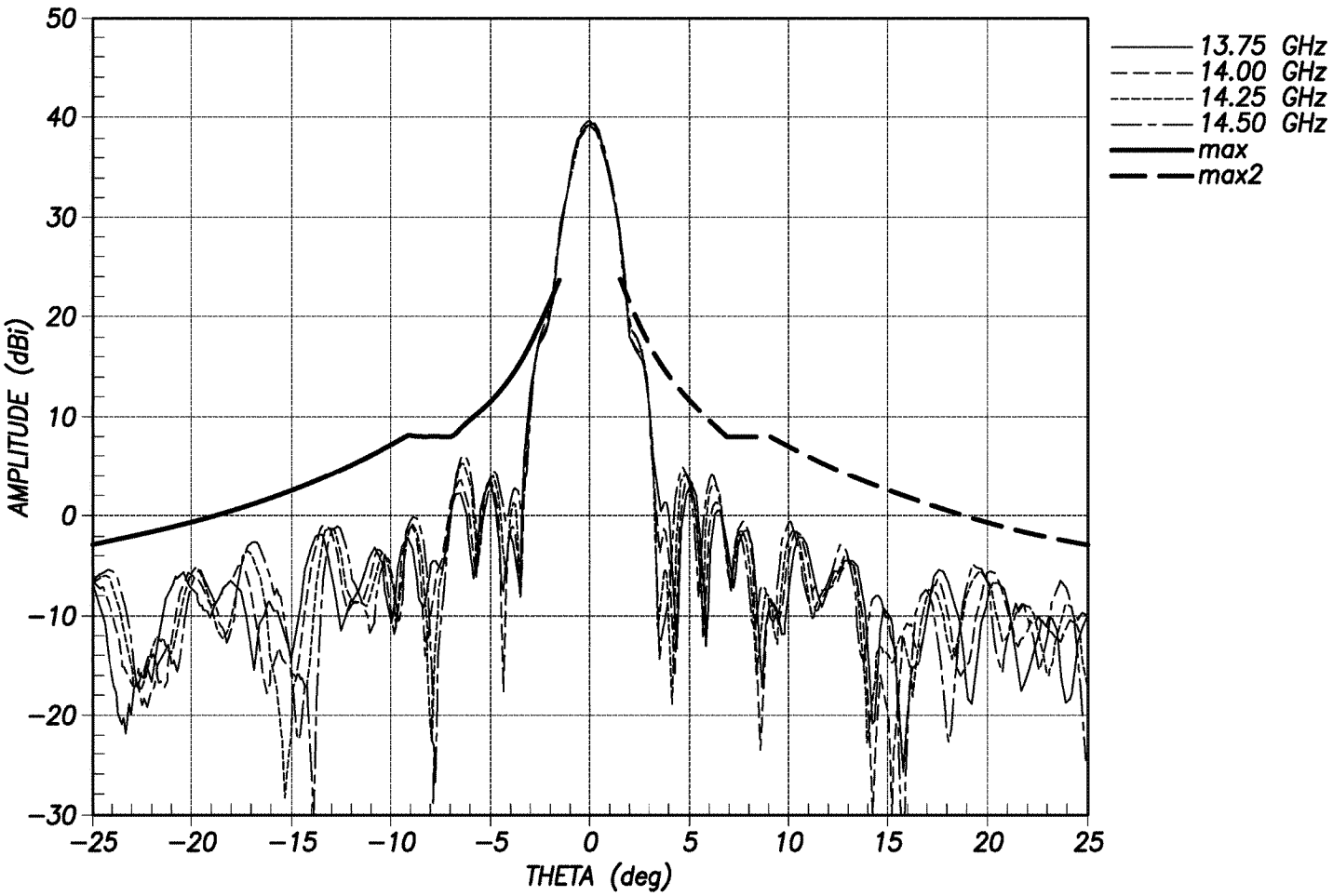
FIG. 7 is a graph showing an example of the pattern for an oval antenna using a prior-art feed horn, in the azimuth plane with horizontal polarization.
Figure 8:
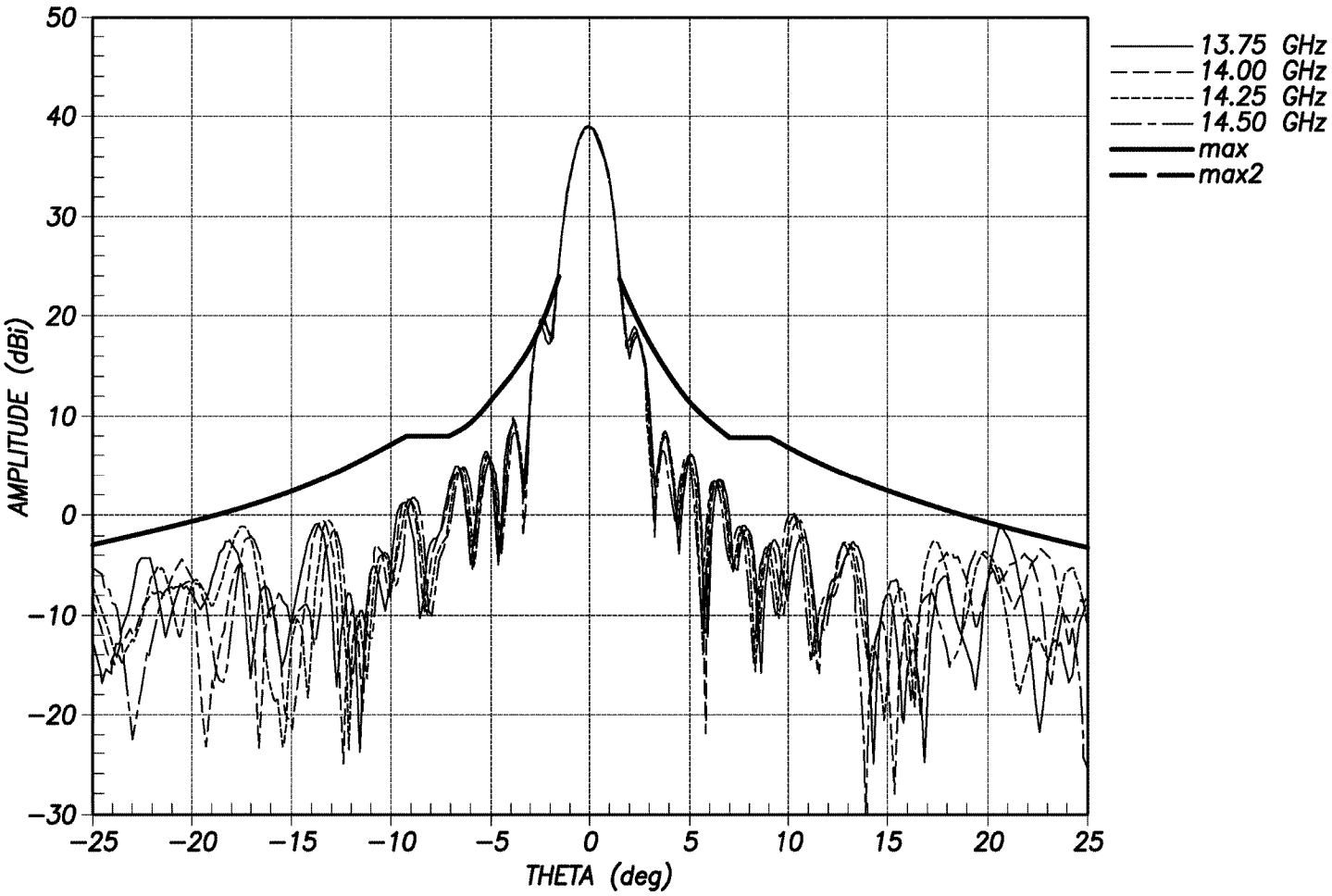
FIG. 8 is a graph showing an example of the pattern for an oval antenna using a prior-art feed horn, in the azimuth plane with vertical polarization.
Figure 9:
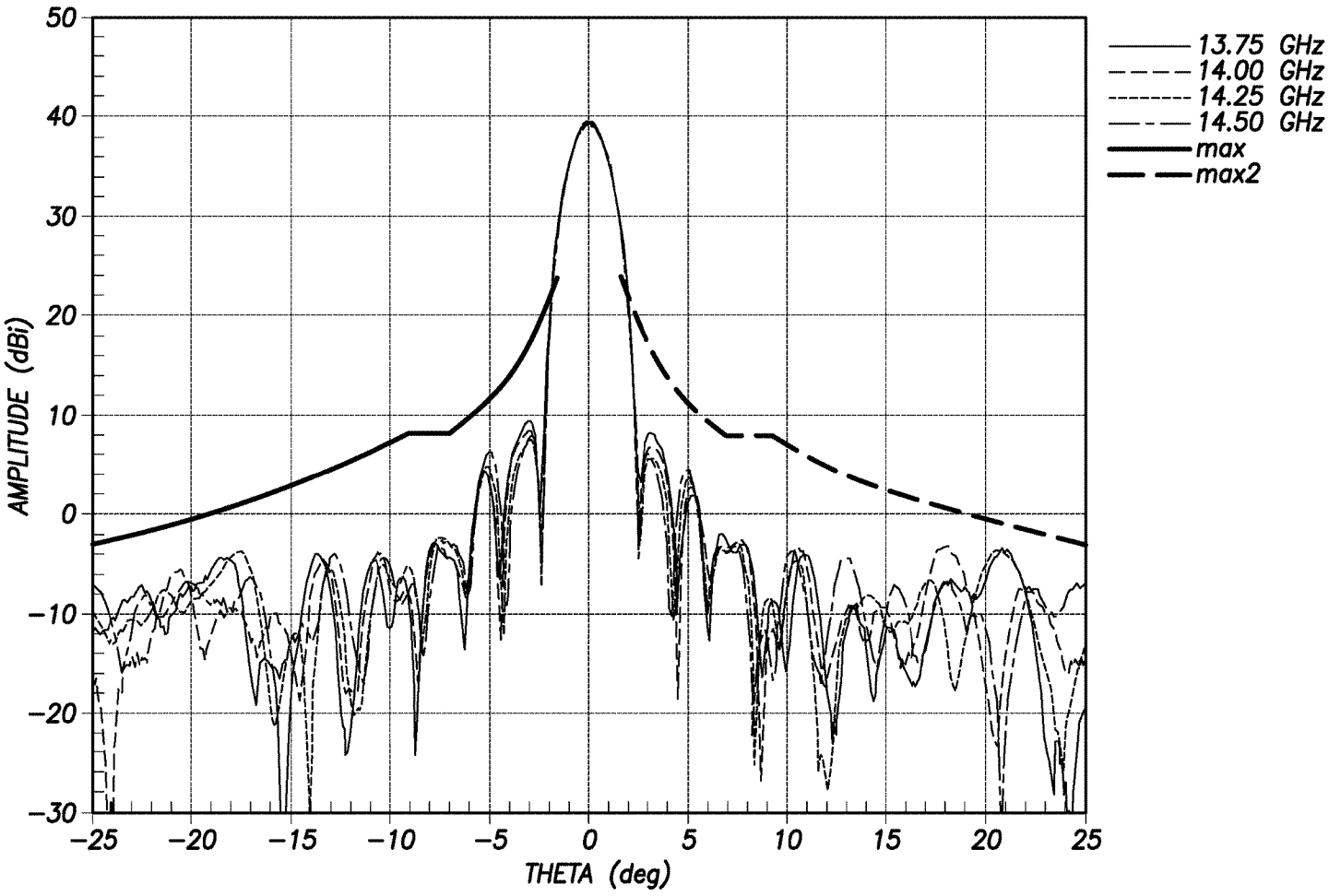
FIG. 9 is a graph showing an example of the pattern of an oval antenna using the present feed horn, in the azimuth plane with horizontal polarization.
Figure 10:
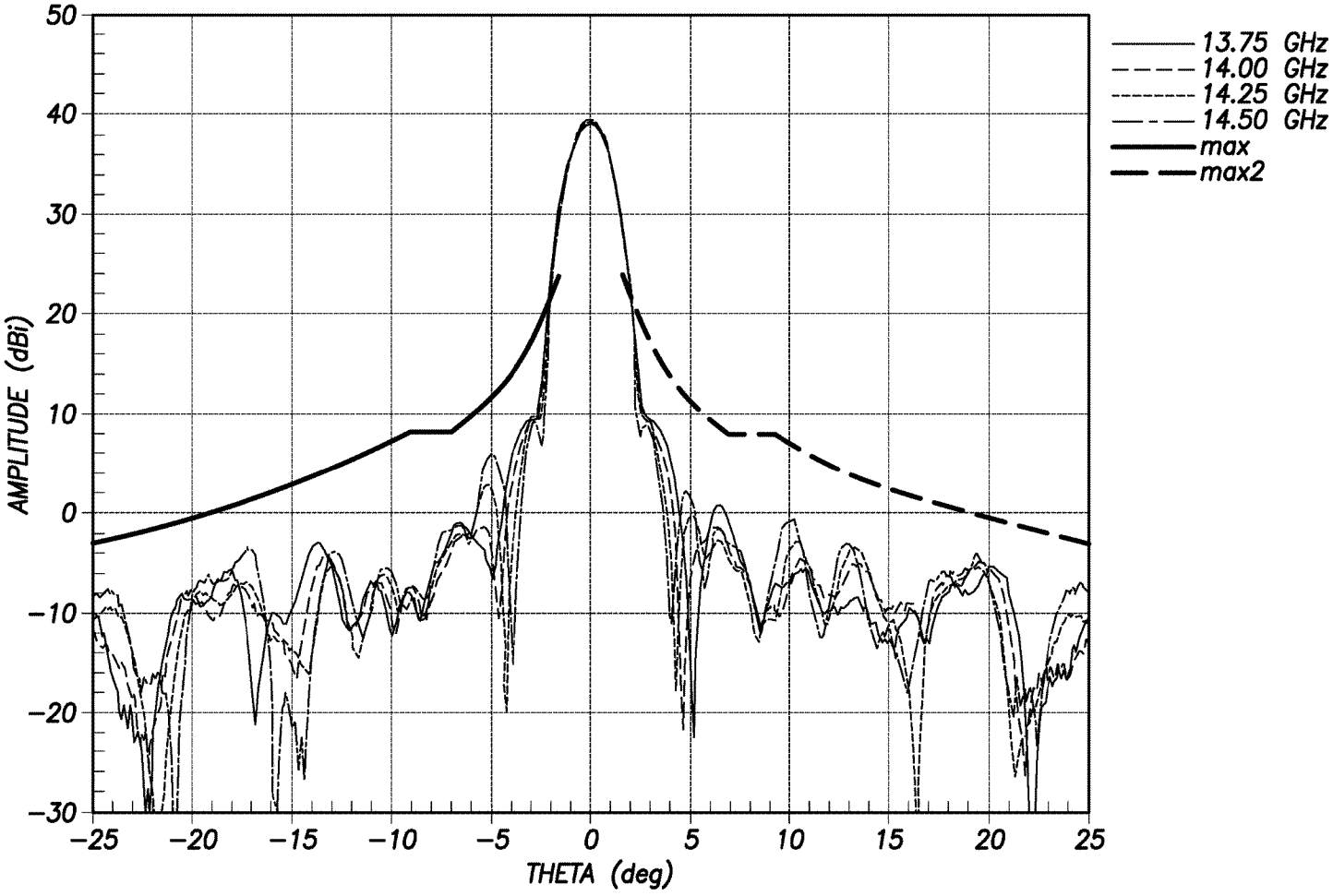
FIG. 10 is a graph showing an example of the pattern of an oval antenna using the present feed horn, in the azimuth plane with vertical polarization.

It should be noted that present feed horn 10 has different semi-flare angles 50 around the circumference of the aperture (i.e., the semi-flare angle varies as it sweeps around the circumference of the aperture). But, by careful adjustment of width, depth, and height of the corrugations 20, 25 and intermediate ridges 30, it is possible to achieve a very smooth oval beam, resulting in very low side lobes of the antenna it is used with. FIGS. 7-8 are graphs showing the patterns for an oval antenna using a prior-art feed horn in the azimuth plane with horizontal and vertical polarization, respectively. FIGS. 9-10 show the corresponding patterns for the same antenna using the present feed horn 10. As illustrated in these graphs, an antenna with present horn 10 has lower side lobes and passes FCC requirements while the same antenna with the prior-art horn does not.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A feed horn for an antenna comprising:

a tubular waveguide extending along a central projection axis leading to an aperture;

a plurality of corrugations extending outward from the projection axis around the aperture in a nested non-circular pattern of curved corrugation ridges having a major axis and a minor axis; said corrugation ridges rising parallel to the projection axis and being separated by slots; and intermediate ridges spaced between the corrugation ridges only adjacent to the major axis.

2. The feed horn of claim 1 wherein said intermediate ridges are interstitially spaced in the slots between the corrugation ridges near the major axis.

3. The feed horn of claim 1 wherein the corrugation ridges are substantially oval.

4. The feed horn of claim 1 wherein the corrugation ridges are substantially elliptical.

5. The feed horn of claim 1 wherein the intermediate ridges have ends spatially separated from the corrugation ridges.

6. The feed horn of claim 1 wherein the intermediate ridges have heights between the heights of the adjacent corrugation ridges.

7. The feed horn of claim 1 wherein the intermediate ridges are curved to approximate the shape of the corrugation ridges.

8. The feed horn of claim 1 wherein the intermediate ridges maintain a substantially uniform slot width along the major and minor axes.

9. The feed horn of claim 1 wherein the corrugated ridges have different semi-flare angles around the circumference of the aperture.

10. A feed horn for an antenna comprising:

a tubular waveguide extending along a central projection axis leading to an aperture;

a plurality of corrugations extending outward from the projection axis around the aperture in a nested pattern of elliptical corrugation ridges having a major axis and a minor axis; said corrugation ridges rising parallel to the projection axis and having wider spacings between corrugation ridges adjacent to the major axis than the minor axis; and intermediate ridges spaced between the corrugation ridges only in the regions of the slots adjacent to the major axis and being separated by slots, said intermediate ridges and corrugation ridges defining slots adjacent to the major axis having widths substantially the same as the slots between adjacent corrugation ridges adjacent to the minor axis.

11. The feed horn of claim 10 wherein said intermediate ridges are interstitially spaced in the slots between the corrugation ridges near the major axis.

12. The feed horn of claim 10 wherein the intermediate ridges have ends spatially separated from the corrugation ridges.

13. The feed horn of claim 10 wherein the intermediate ridges have heights between the heights of the adjacent corrugation ridges.

14. The feed horn of claim 10 wherein the intermediate ridges are curved to approximate the shape of the corrugation ridges.

15. The feed horn of claim 10 wherein the corrugated ridges have different semi-flare angles around the circumference of the aperture.

* * * * *